US008325128B2

(12) United States Patent
Katayama et al.

(10) Patent No.: US 8,325,128 B2
(45) Date of Patent: Dec. 4, 2012

(54) DISPLAY DEVICE AND DRIVING CIRCUIT THEREOF

(75) Inventors: Yukari Katayama, Chigasaki (JP); Yoshiki Kurokawa, Tokyo (JP); Akihito Akai, Yokohama (JP); Goro Sakamaki, Fuchu (JP)

(73) Assignee: Renesas Electronics Corporation, Kawasaki-shi (JP)

( * ) Notice: Subject to any disclaimer, the term of this patent is extended or adjusted under 35 U.S.C. 154(b) by 1046 days.

(21) Appl. No.: 12/170,518

(22) Filed: Jul. 10, 2008

(65) Prior Publication Data

US 2009/0015532 A1 Jan. 15, 2009

(30) Foreign Application Priority Data

Jul. 12, 2007 (JP) ..... 2007-183299

(51) Int. Cl.
*G09G 3/36* (2006.01)

(52) U.S. Cl. ..... 345/101; 345/89; 345/102; 345/204; 345/690; 349/72; 362/97.1; 362/97.3

(58) Field of Classification Search ..... 345/89, 345/690, 101, 102, 204; 349/72; 362/97.1, 362/97.3
See application file for complete search history.

(56) References Cited

U.S. PATENT DOCUMENTS

| | | | | |
|---|---|---|---|---|
| 7,639,312 | B2 * | 12/2009 | Baba et al. | 348/790 |
| 7,760,178 | B2 | 7/2010 | Takada et al. | |
| 2003/0231158 | A1 * | 12/2003 | Someya et al. | 345/101 |
| 2007/0222726 | A1 * | 9/2007 | Chen et al. | 345/87 |
| 2007/0262972 | A1 | 11/2007 | Nakata | |
| 2009/0135123 | A1 | 5/2009 | Yamato et al. | |
| 2010/0277519 | A1 * | 11/2010 | Lee | 345/691 |

FOREIGN PATENT DOCUMENTS

| | | | |
|---|---|---|---|
| JP | 2001-27890 | A | 1/2001 |
| JP | 2003-207762 | A | 7/2003 |
| JP | 2003-255306 | A | 9/2003 |
| JP | 2004-163873 | A | 6/2004 |
| JP | 2004-177575 | A | 6/2004 |
| JP | 2004-295141 | A | 10/2004 |
| JP | 2005-266154 | A | 9/2005 |
| JP | 2006-126292 | A | 5/2006 |
| JP | 2006-146134 | A | 6/2006 |
| JP | 2007-052347 | A | 3/2007 |

(Continued)

OTHER PUBLICATIONS

Office Action of Mar. 6, 2012, in Japanese Patent Application No. 2007-183299. Office Action of Jul. 3, 2012, in Japanese Patent Application No. 2007-183299.

*Primary Examiner* — Lun-Yi Lao
*Assistant Examiner* — Sosina Abebe
(74) *Attorney, Agent, or Firm* — Miles & Stockbridge P.C.

(57) ABSTRACT

In a display device such as a liquid crystal display, a processing for compressing a range of display data (grayscale) to a low grayscale side (a grayscale range where response is fast) except for a high grayscale side (a grayscale range where response is slow) at a predetermined compression ratio to conduct display according to response characteristic of transition between grayscales and a temperature state and a processing for increasing a light amount of a backlight to compensate for luminance change due to the compression are performed, for example, in a liquid crystal panel of TN liquid crystal. Thereby, response can be made fast even at a low temperature time.

10 Claims, 10 Drawing Sheets

FOREIGN PATENT DOCUMENTS

| | | | |
|---|---|---|---|
| JP | 2007-108439 | A | 4/2007 |
| JP | 2007-133051 | A | 5/2007 |
| JP | 2008-020858 | A | 1/2008 |
| KR | 10-2007-0040999 | | 4/2007 |
| WO | WO 2006/112110 | A1 | 10/2006 |
| WO | WO 2007/074560 | A1 | 7/2007 |

* cited by examiner

DISPLAY DEVICE AND DRIVING CIRCUIT THEREOF

CROSS-REFERENCE TO RELATED APPLICATION

The present application claims priority from Japanese Patent Application No. JP 2007-183299 filed on Jul. 12, 2007, the content of which is hereby incorporated by reference into this application.

TECHNICAL FIELD OF THE INVENTION

The present invention relates to a display device which is provided with a light source whose light amount can be controlled and conducts display by controlling a transmissivity control element which is disposed on a front face side of the light source and can control a light transmissivity and a driving circuit of the same, and in particular to a liquid crystal display device (a liquid crystal display) provided with a liquid crystal element (a liquid crystal panel) and a driving circuit (an LSI or the like) thereof.

BACKGROUND OF THE INVENTION

As a display device provided with a light source and a transmissivity control element, there is a liquid crystal display provided with a backlight and a liquid crystal panel. For example, a liquid crystal display for vehicle mounting used in a car navigation system or the like is required to operate stably in a wide temperature range of −45° C. to 95° C. The liquid crystal display for vehicle mounting is required to have performance (function) of displaying, on a liquid crystal screen, moving picture such as, for example, a map scrolling behavior from a starting time of a vehicle, and it is further required to be capable of conducting displaying at a sufficiently high speed or practical response speed even at a time of such a low temperature as 0° C. or lower.

On the other hand, a response speed of the transmissivity control element (a liquid crystal element) varies according to element (panel) characteristic and a temperature state. For example, the liquid crystal generally has such a property that its response speed lowers according to temperature lowering.

Regarding a response speed in the above-mentioned display device, for example, as shown in Japanese Patent Application Laid-Open Publication No. 2004-163873 (Patent Document 1), there is a technique of speeding up the response speed of a moving picture display utilizing an overdrive technique in the liquid crystal display. In the technique, a contrivance for speeding up the response speed at a low temperature time by controlling an overdrive application voltage according to an ambient temperature to conduct a proper application voltage even at a low temperature is adopted.

As described above, the display device such as a liquid crystal display is required to be capable of responding at a sufficiently high speed in a wide temperature range including, especially, a low temperature time, but, for example, such a case occurs in a liquid crystal display for vehicle mounting or the like that the response speed becomes slow according to element characteristic and a temperature state (for example, at a low temperature time) so that desirable display can not be obtained. In such an element as a liquid crystal element, response characteristic to transition between grayscales in pixel display between frames (characteristic of a transition time in combination of an input grayscale value of the previous frame and an output grayscale value of the current frame) is not even. For example, a TN liquid crystal has such a property that response of transition to a high grayscale side is slow and the response becomes further slow at a low temperature time.

Especially, regarding the above-mentioned overdrive technique and liquid crystal display for vehicle mounting or the like, a first problem lies in that a frame memory or the like must be provided for conducting overdrive on the display so that realization may be difficult due to a cost factor or the like. A second problem lies in that, since usage voltage in a system for the display is designed to be constant, such a case often arises that overdrive is not so effective when temporal transition to the highest grayscale or the lowest grayscale occurs in pixel display between frames.

SUMMARY OF THE INVENTION

In view of these circumstances, the present invention has been made and an object thereof is to provide a technique which can respond at a sufficient high speed according to element characteristic and a temperature state (especially, a wide temperature range including a low temperature time) in such a display device as a liquid crystal display and a technique which can realize such a sufficient high speed at a low cost.

Especially, an another object of the present invention is to provide a technique which can handle lowering of response at a low temperature time of a liquid crystal and can improve characteristics of moving picture display in the liquid crystal display.

In order to achieve the above problem, according to the present invention, there is provided a technique regarding a display device provided with a light source whose light amount is controlled and an element by which light transmissivity is controlled, and a driving circuit thereof, for example, a liquid crystal display device provided with a backlight and a liquid crystal element, and a driving circuit thereof, where the following configurations are provided. The following characteristic configurations may be realized within the display device or may be realized within the driving circuit.

(1) As described above, response characteristic to transition between grayscales (transmissivities) varies according to a temperature or the like in such an element as a liquid crystal element, and an element with a relatively fast response characteristic and an element with a relatively slow response characteristic (a combination thereof) are present. For example, the following configurations can be provided based upon the above.

(1-1) In a device (a display device or a driving circuit) of the present invention, when an image (moving picture) is displayed according to control to an element and a light source, a first processing for changing a range of transmissivity (grayscale) regarding display data, voltage, or the like to a low side or a high side is performed according to element characteristic and a temperature state such that a whole range (all output grayscales) of transmissivity (grayscale) is ordinarily used for displaying, for example, at the normal temperature time or a high temperature time, for example, at a time of a reference temperature (for example, 0° C.) or lower, while a partial range of the whole range where the response speed becomes relatively fast sufficiently is used for displaying at a low temperature time, for example, at a time of less than the reference temperature (for example, 0° C.) (a range where the response speed becomes relatively slow in the element is not used for displaying).

In other words, in the device according to the present invention, the first processing for changing transmissivity of an element caused to correspond to the grayscale of a display image, for example, conducting compression to a low grayscale side as a whole is performed such that a partial range of the whole transmissivity (all grayscales) where the response speed at the element is fast is used for displaying, for example, when a temperature state near the device is at a low temperature.

(1-2) In the device according to the present invention, according to displaying performed while the range of transmissivity (grayscales) is changed by the first processing, a second processing for changing a light amount of a light source (backlight) is performed responding to the change (luminance change). For example, according to changing the transmissivity of the element to a low side to lower the luminance by the first processing, a light amount of the light source is increased to raise the luminance by the second processing.

(1-3) In the device according to the present invention, the luminance is compensated for by controlling the first and second processings in a correlating manner. That is, compensation is performed, for example, so as to obtain the original luminance or approach the same by compressing the range of grayscale of display data according to a temperature state to conduct display in the first processing and controlling increase or decrease of the light amount (luminance) of the light source corresponding to a ratio of luminance changed by the first processing in the second processing.

(2) The device according to the present invention has, for example, the following configuration. In the device according to the present invention, regarding the first processing, change is performed so as to use a portion of the grayscale (transmissivity) of the display image according to the temperature state of the element (the temperature detected from the vicinity of the element) and characteristic of the response speed to transition between transmissivities in the element. In the device according to the present invention, a circuit which receives information about the temperature near the element and changes the range of grayscale (transmissivity) of the display image and further the light amount of the light source according to the temperature is provided. In the device according to the present invention, a circuit which receives information about the temperature near the element and changes the range of grayscale (transmissivity) of the display image according to characteristic of the response speed of transition between grayscales (tranmissivities) of the element is provided.

(3) In the device according to the present invention, the above-mentioned element is, for example, a TN liquid crystal element, which has normally-white characteristic that the transmissivity (grayscale) reaches the maximum (the lowest voltage application grayscale is the highest grayscale) at a non-application time of application voltage and characteristic that transition to a high grayscale state is relatively slow. In the first processing, the range of grayscale of the display image (display data) is compressed to a low portion (low grayscale side) at a low temperature time (in case of less than the reference temperature) as compared with the range of grayscale at an ordinary time (in case of higher than the reference temperature). In the second processing, control is performed so as to increase the light amount of the light source according to lowering of luminance due to the compression to the low side.

(3-1) For example, in the device according to the present invention, a selector circuit which changes a voltage value (reference voltage value) inputted to a grayscale voltage generating circuit (ladder circuit) in the driving circuit according to a temperature state or the like is provided in order to change the range of grayscale to a lower side at a low temperature time.

(3-2) In the device according to the present invention, for example, a plurality of $\gamma$ adjustment setting values inputted into the grayscale voltage generating circuit is prepared and a selector circuit which selects/changes the $\gamma$ adjustment setting value according to a temperature state or the like is provided.

(3-3) For example, the device according to the present invention is provided with a selector circuit which has a configuration that the number of grayscale voltages generated by grayscale voltage generating circuit is more than the number of grayscales of an image to be displayed and which selects a grayscale voltage according to a temperature.

(3-4) For example, the device according to the present invention is provided with a circuit which carries out operation for compressing the range of grayscale of display data of a display image to a low side by multiplying a grayscale value of the display data by a fixed value (compression factor: $\beta$) equal to or less than 1 for compression.

(3-5) For example, the device according to the present invention is provided with a circuit which multiplies a grayscale voltage to the liquid crystal element by a factor corresponding to a grayscale difference value between images to conduct overdrive, where a grayscale voltage regarding a grayscale which is not used by compression of the range of grayscale is used as a grayscale voltage for overdrive (overdrive application voltage).

(4) In the device according to the present invention, the above-mentioned element is, for example, a VA liquid crystal element, which has normally-black characteristic that the transmissivity (grayscale) reaches the minimum (the lowest voltage application grayscale is the lowest grayscale) at a non-application time of application voltage and characteristic that transition of grayscale from a low grayscale state to an intermediate grayscale state is relatively slow. In the first processing, the range of grayscale of the display image (display data) is compressed to a high portion (high grayscale side) at a low temperature time (in case of less than the reference temperature) as compared with the range of the grayscale at the ordinary temperature time (in case of higher than the reference temperature). In the second processing, control is performed so as to decrease the light amount of the backlight according to rising of luminance due to the compression to the high side.

According to the present invention, in such a display device as a liquid crystal display, response at a sufficient high speed can be performed according to element characteristic and a temperature state (especially, a wide temperature range including a low temperature time) and such response can be realized at a low cost. Especially, in the liquid crystal display, lowering of response at a low temperature time of liquid crystal can be handled so that characteristic of moving image display can be improved.

Effects corresponding to respective configurations in means for solving the problem are as follows: According to the above items (1) and (2), excellent response characteristic can be obtained even at a low temperature time. Especially, according to the above-mentioned item (1-3), display luminance is not so changed relative to the original luminance at a low temperature time or the like, so that excellent display characteristic is obtained.

According to the above-mentioned item (3), in a TN liquid crystal or the like, excellent response characteristic can be obtained even at a low temperature time. According to the above-mentioned item (3-1), the number of display grayscales is not reduced even if compression of display data is performed. According to the above-mentioned item (3-2), excellent γ characteristic can be kept even if compression of display data is performed. According to the above-mentioned item (3-3), γ characteristic can be kept excellent even if a plurality of γ adjustment setting values is not provided. According to these configurations, grayscale jumping does not occur owing to an analog processing. According to the above-mentioned item (3-4), a circuit configuration is made relatively simple according to the digital processing so that low cost can be achieved. According to the above-mentioned item (3-5), further high-speed response can be obtained by performance of overdrive.

According to the above-mentioned item (4), in a VA liquid crystal or the like, excellent response characteristic can be obtained even at a low temperature time. In case of a combination with the above-mentioned item (1-3), separation of black luminance is suppressed so that excellent display quality can be maintained.

BRIEF DESCRIPTIONS OF THE DRAWINGS

These and other features, objects, and advantages of the present invention will become more apparent from the following description when taken in conjunction with the accompanying drawings wherein.

Figure 11:
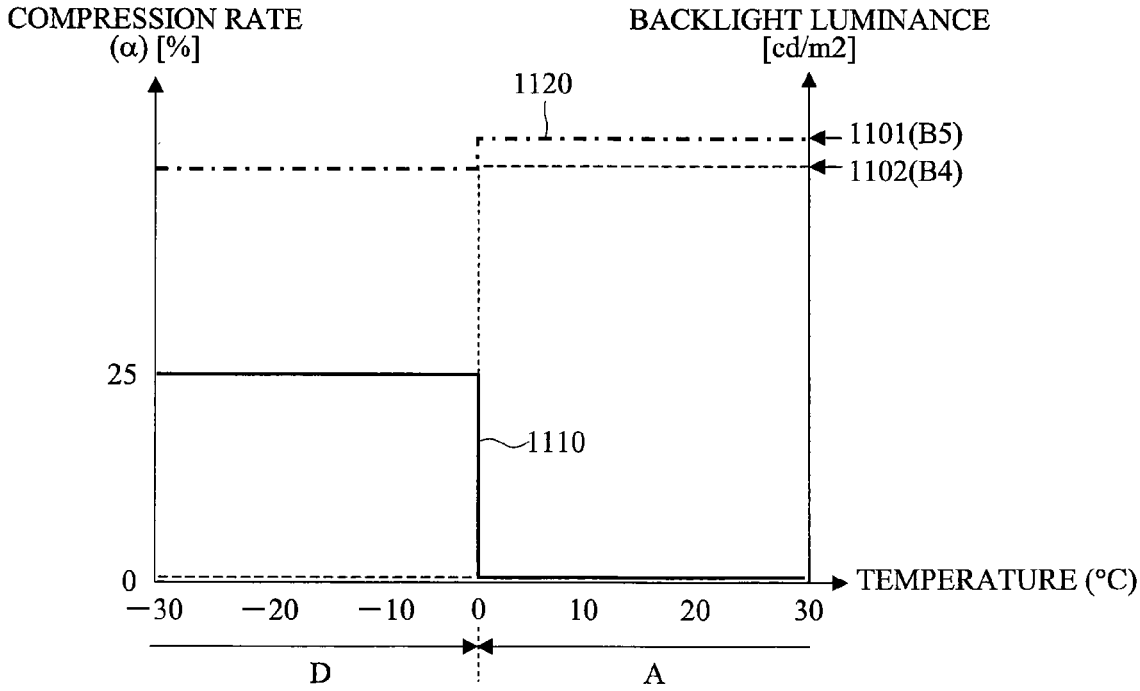
Figure 12:
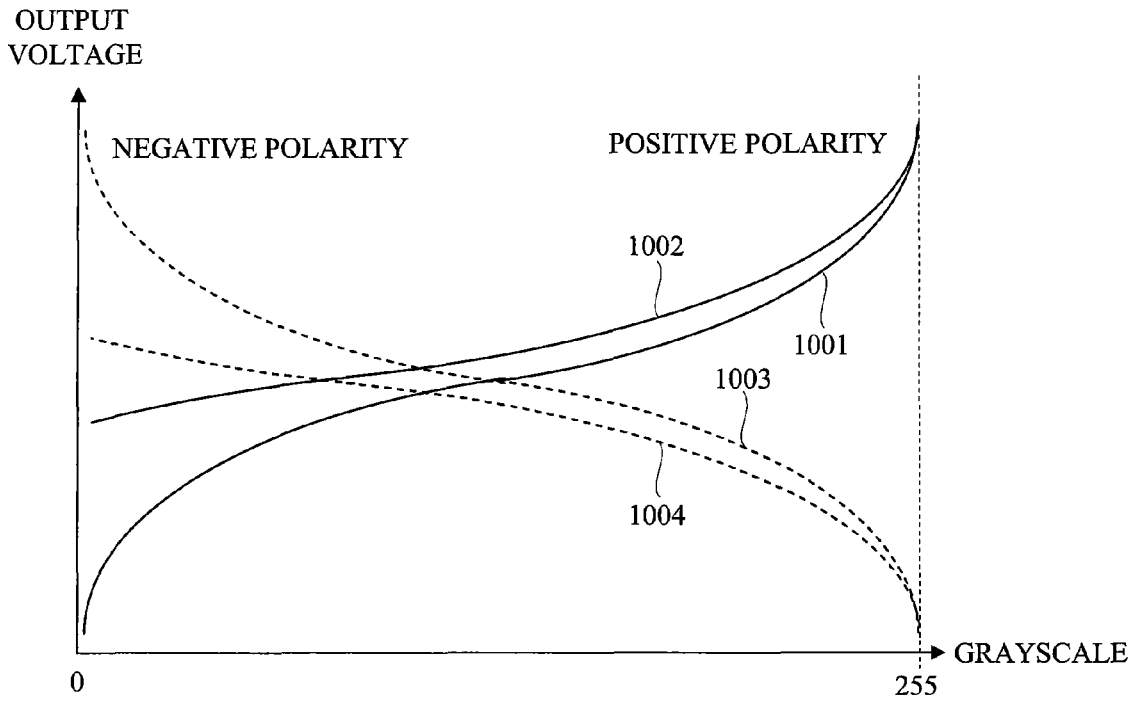

FIG. 11 is a diagram showing a relationship between a temperature, and a compression ratio of display data and backlight luminance according to the fourth embodiment of the present invention; and FIG. 12 is a diagram showing a relationship between grayscale of display data and output voltage (liquid crystal application voltage which is an output from a DA converter) according to the fourth embodiment of the present invention.

DESCRIPTION OF THE EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted.

<Prior Art>

Before embodiments of the present invention are explained, examples of the prior art and the problems which are related to the embodiments and have examined in BACKGROUND OF THE INVENTION will be explained in a supplementary manner.

Regarding the above-mentioned overdrive technique and liquid crystal display for vehicle mounting, the particulars of the first problem are as follows: In the overdrive technique, application voltage (overdrive application voltage) is controlled using a difference (grayscale difference value) between the current frame and the previous frame by one regarding display data of a display image (pixel group). Thereby, in the display device, it is essential to provide a frame memory storing display data (grayscale data) corresponding to one frame therein.

However, a demand of cost reduction for a liquid crystal display for vehicle mounting, mobile application or the like is severe, so that it is often difficult to provide the liquid crystal display with the frame memory or the like. That is, in the liquid crystal display, it is often difficult to realize the overdrive (improvement of a response speed achieved by the overdrive) in itself.

The second problem will be described in detail below. In the overdrive technique, when there is a difference in display data (grayscale value) between the previous frame and the current frame, application is performed by adding voltage increased according to increase of the difference value to voltage to be applied to the display data (grayscale value) of the current frame as overdrive application voltage. Thereby, rapid rising characteristic is obtained.

Generally, in a liquid crystal driver (a driving circuit for a liquid crystal display), voltage to be used within the driver is set in accordance with a grayscale displayed by application of the highest voltage (called "maximum voltage application grayscale": 255-grayscale in a normally black crystal liquid and 0-grayscale in a normally white crystal liquid). When a display pixel of the current frame is the highest grayscale, a voltage sufficiently higher than the highest grayscale application voltage (at a non-overdrive time) is required as the overdrive application voltage in order to conduct overdrive. However, the maximum value of the voltage is naturally determined from cost reduction demand, a size of the driver or the like. Therefore, it is impossible to apply a voltage (overdrive application voltage) equal to or more than the maximum value.

An application voltage of a grayscale (the minimum voltage application grayscale: 0-grayscale in the normally black liquid crystal and 255-grayscale in the normally white liquid crystal) to be displayed by application of the lowest voltage is ordinarily 0V, and a sufficiently low negative voltage is required to conduct overdrive. Regarding this, similarly, the lowest value of the voltage is naturally determined so that application of a voltage equal to or less than the lowest value is impossible.

From the above, when transition to the highest grayscale or the lowest grayscale occurs in pixel display between frames, such a case often arises that the overdrive is not so effective. Especially, In a TN liquid crystal with the normally white characteristic or the like, it is generally known that transition to the lowest voltage application grayscale (255-grayscale which is the highest grayscale) among response characteristic between respective grayscales in pixel display between frames, namely, a relation (combination) of a temporal transition of input/output grayscales is slowest regarding response (longest regarding the transition time). Overdrive is not so effective to such transition.

For example, in normal driving, a voltage range is from 0V (grayscale value 0) to 5V (grayscale value 255), while the voltage range becomes wider than the above range (0V to 5V) in overdrive driving. Since only a fixed voltage range is secured in a systematic (circuit) manner, overdrive is not effective near the minimum grayscale (0) or the maximum grayscale (255).

As described above, there is a case that the overdrive technique is not effective. Therefore, a technique where lowering of response at a low temperature time of liquid crystal can be handled without depending on the overdrive technique is required in the liquid crystal display or the like.

First Embodiment

In view of the above circumstances, a display device (liquid crystal display) and a driving circuit (liquid crystal driver) of the same according to a first embodiment of the present invention will be explained with reference to FIG. 1 to FIG. 6. In the first embodiment, display data compression and control of a backlight light amount corresponding to liquid crystal characteristic and a temperature state are performed as a characteristic system in the present invention, and they are realized especially by configurations of a DA converting section 311 and a backlight controller 312 within a liquid crystal driver 301 shown in FIG. 3. In the above control, a grayscale range of display data is compressed to a low grayscale side (range change) at a low temperature time and a light amount of backlight is increased in correlation with an amount of lowered luminance due to the compression so that the luminance is caused to approach the original luminance.

<Brief Summary>

First, referring to FIGS. 1 and 2, brief summary of a processing (display data compression, control of backlight light amount, and the like) performed in a display device (liquid crystal display) and a driving circuit (liquid crystal driver) of embodiments (first, second and third embodiments) of the present invention will be explained simply.

Figure 1:
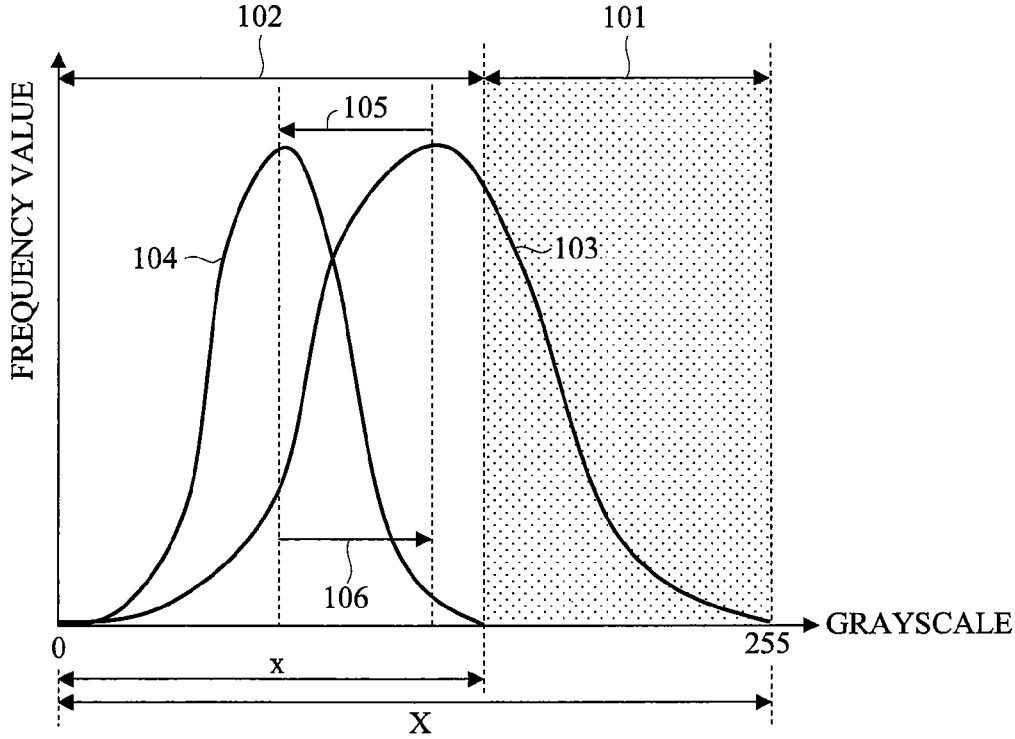
FIG. 1 is a diagram showing a concept of a characteristic configuration in a display device and a driving circuit according to embodiments (first to third embodiments) of the present invention in a histogram form of pixel grayscale of a display image.

FIG. 1 shows an example of a histogram of grayscale values of display data of a display image frame applied to this display device, where a horizontal axis shows grayscales of display (0 to 255 grayscales) and a vertical axis shows a frequency value of grayscales of display. The number of all grayscales (256) and a range thereof are represented by X. The number of grayscales at a compression time (low temperature time) is represented by x. Reference numeral 101 denotes a grayscale range (high grayscale range 101) where response is slow, while 102 denotes a grayscale range (low grayscale range 102) where response is fast regarding characteristic of the liquid crystal element (liquid crystal panel). These ranges and boundaries show a case where a dual partitioning has been performed regarding high grayscales and low grayscales for simplification in this example.

Reference numeral 103 denotes a display image histogram (to-be compressed display data 103) corresponding to the whole grayscale range X at an ordinary time (the ordinary temperature time or a high temperature time), while 104 denotes a display image histogram (compressed display data 104) corresponding to a grayscale number x at a compression time (low temperature time).

Generally, in a normally white TN liquid crystal, response characteristic between grayscales has such a property that transition to a high grayscale side is slow while transition to a low grayscale side is fast. In the present embodiment, in order to improve response speed at a low temperature time, operations (processing) shown by reference numerals 105 and 106 in FIG. 1 are performed. That is, in the operation 105, an operation (a grayscale (display data) compression processing 105) for multiplying the to-be compressed display data 103 of a display image to be displayed on the display device by a fixed value (compression factor: β) which is 1 or less for compression to perform compression to the low grayscale side as a whole and conducting display by the compressed display data 104 is performed.

In the operation 106, an operation (backlight increasing processing 106) for increasing a light amount of the backlight by an amount corresponding to lowering of luminance due to the grayscale compression processing 105 is performed. Thereby, compensation is performed so as to restore (approach) the original grayscale (luminance). Thereby, since an image can be displayed using only the low grayscale range 102 side where response is fast, the response speed can be considerably improved at the low temperature time.

In the display data compression (grayscale compression processing 105), the compression ratio α% is defined as the following mathematical expression (1) using the compressed grayscale number x to the whole grayscale number X:

$$\alpha = \frac{(X - x)}{X} \times 100 \qquad \text{A}(1)$$

In the TN liquid crystal, since a transition time to a high grayscale becomes long (the response time becomes slow) according to movement to the high grayscale, a portion (the high grayscale range 101) where the response is slow is not used according to rising of the compression ratio α, so that an average response time becomes short. However, the light amount of the backlight becomes large according to rising of the compression ratio α (when the original luminance is restored).

Figure 2:
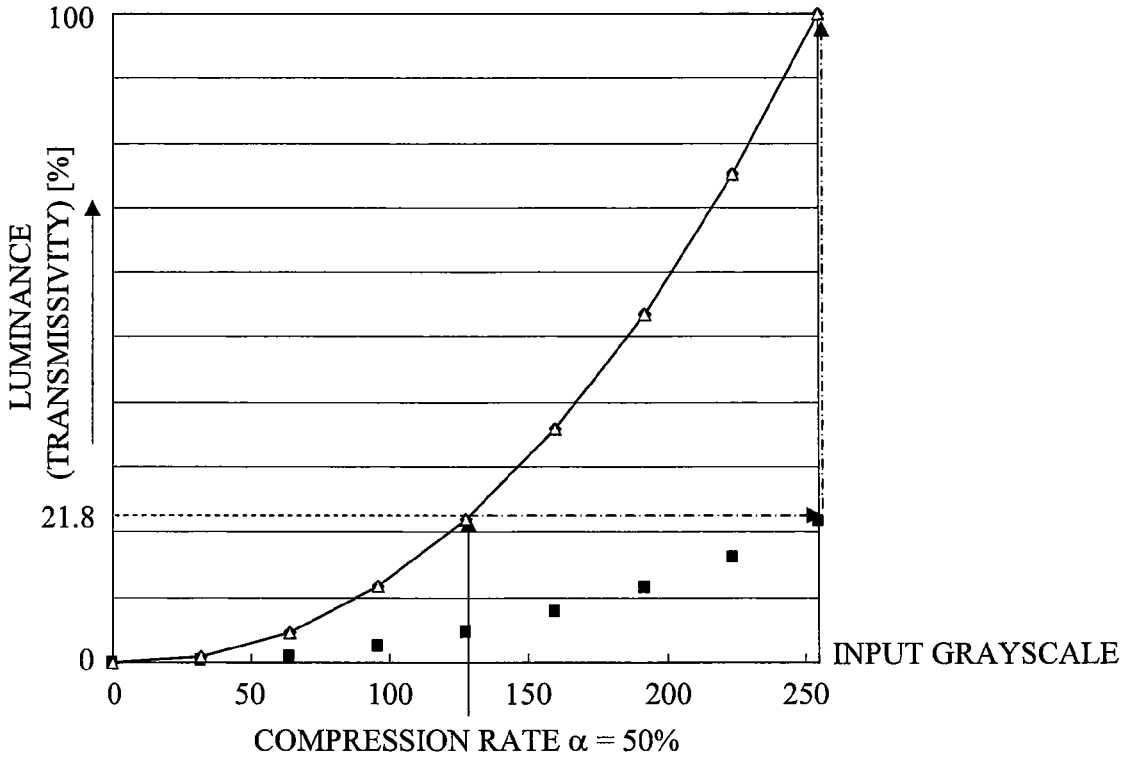
FIG. 2 is a diagram showing a relationship between characteristic of input grayscale-luminance (transmissivity), and data compression and backlight luminance according to the embodiments (first to third embodiments) of the present invention.

In FIG. 2, characteristic of input grayscale (0 to 255)—luminance (transmissivity) % in case of characteristic of γ=2.2 which is grayscale luminance characteristic (γ characteristic) of a common liquid crystal is shown. In the grayscale compression processing 105, for example, when the compression ratio α is 50%, a ratio of the luminance value where the grayscale is 128 and the luminance value where the grayscale is 255 is represented by the following mathematical expression (2).

$$\left(\frac{128}{255}\right)^{2.2} \approx 0.218 \qquad \text{A}(2)$$

Therefore, in the correlation control of the above-mentioned two processings (105, 106), it is necessary to increase the backlight luminance (light amount) to 4.6 times (inverse number) from the following mathematical expression (3) in order to obtain the same luminance value as the luminance value before compression.

$$\frac{1}{\left(\frac{128}{255}\right)^{2.2}} \approx 4.6 \qquad \Lambda(3)$$

Here, it can be thought that the vertical axis of the grayscale luminance characteristic is the transmissivity of the liquid crystal. Assuming that the transmissivity corresponding to the grayscale of 255 at a time of the compression ratio α=0% is 100%, the transmissivity corresponding to the grayscale of 255 at a time of the compression ratio α=50% is 21.8%. That is, the range of the transmissivity corresponding to 0 to 255 grayscales is changed to a side where the tranmissivity is low.

Incidentally, in supplementary explanation about the response characteristic of transition between grayscales (transmissivities), when an input grayscale value transits from k1 to k2 at a display timing (t1) of pixel grayscale between frames, namely, when an application grayscale voltage to a liquid crystal transits from a grayscale voltage v1 to a grayscale voltage v2 at the timing t1, a transition time T (t2−t1) up to a time t2 where the transmissivity of the liquid crystal changes from a transmissivity s1 of the liquid crystal corresponding to the grayscale voltage v1 to a transmissivity s2 of the liquid crystal corresponding to the grayscale voltage v2 (for example, a time elapsing until the transmissivity changes from 10% to 90%) becomes longer according to movement of the grayscale value (k2, v2) toward a high grayscale side. The transition time T becomes longer according to transition of the temperature of the element toward a lower temperature side.

<Block Configuration>

Next, the first embodiment will be explained in more detail. In the first embodiment, regarding the grayscale compression processing, a system (analog processing) for changing a reference voltage to change a grayscale voltage is adopted and it does not have an overdrive function.

Figure 3:
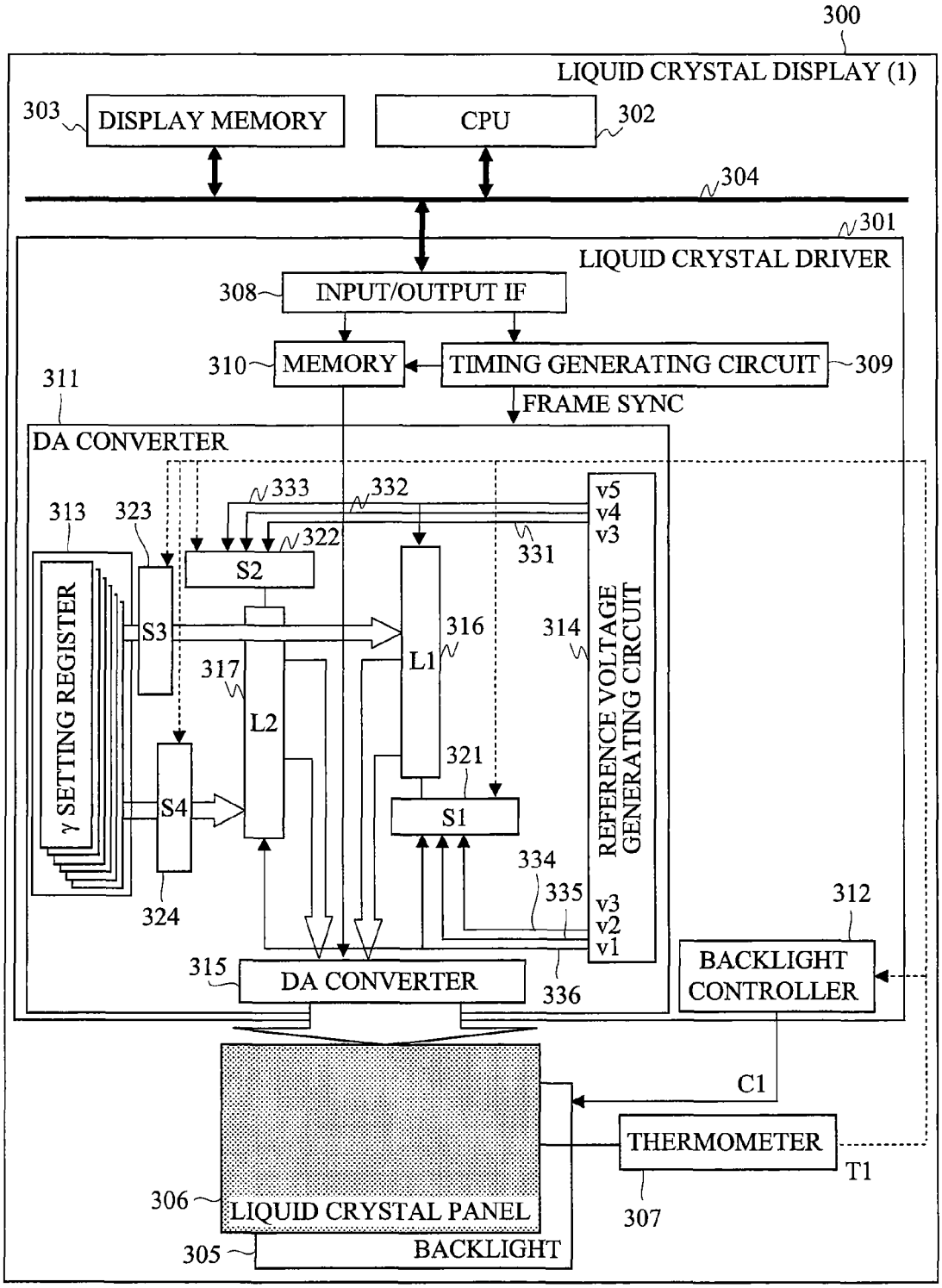
FIG. 3 is a diagram showing a block configuration in a display device according to the first embodiment of the present invention.

FIG. 3 shows a block configuration of a liquid crystal display 300 according to the first embodiment. The liquid crystal display 300 is configured to include a liquid crystal driver 301, a CPU (central processing unit) 302, a display memory (memory) 303, an internal bus 304, a backlight (light source) 305, a liquid crystal panel (liquid crystal screen) 306 using TN liquid crystal, and a thermometer 307. The liquid crystal driver 301 is configured to include an input/output IF (interface circuit) 308, a DA converting section 311, a backlight controller (light source control section) 312, a memory 310, and a timing generating (control) circuit 309.

The DA converting section 311 is configured to include a reference voltage generating circuit 314, γ setting registers (a γ setting register group for respective compression ratios) 313, a positive polarity ladder circuit (L1) 316, a negative polarity ladder circuit (L2) 317, a DA converter 315, a selector (S1) 321, a selector (S2) 322, a selector (S3) 323, and a selector (S4) 324. The reference voltage generating circuit 314 generates and outputs a plurality of reference voltages 331 to 336. The thermometer 307 is provided near the liquid crystal panel 306.

Temperature information T1 from the thermometer 307 is inputted into an input circuit (pin) of the liquid crystal driver 301 to be supplied to respective sections such as the selectors (S1 to S4). The selectors (S1 to S4) receive temperature information T1 and outputs thereof are determined according to values of the temperature information.

<Temperature-Compression Ratio>

Figure 4:
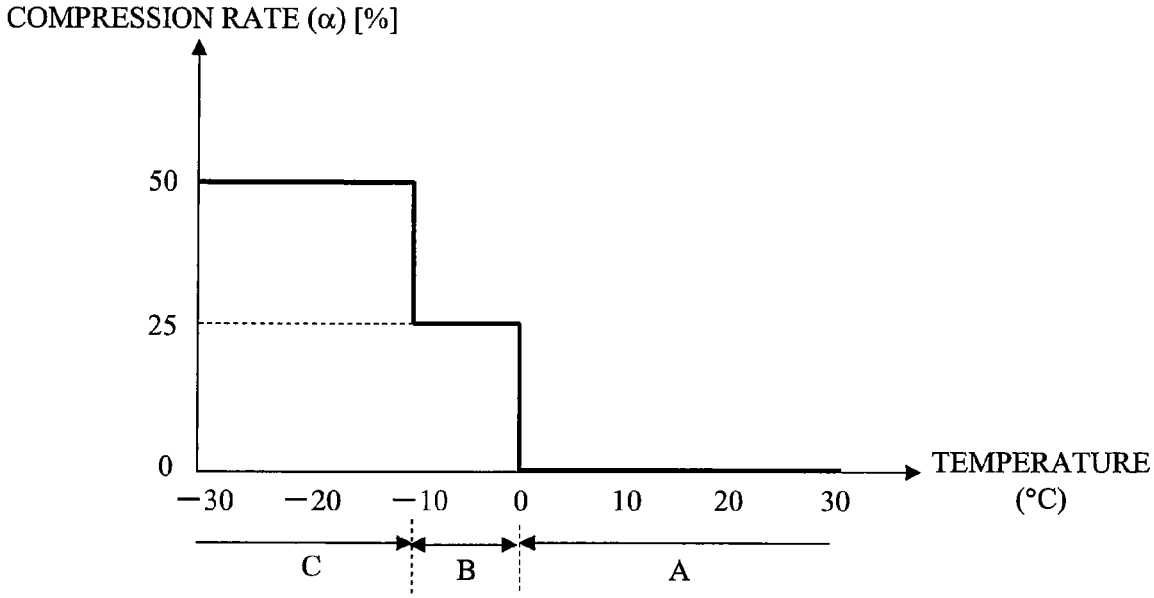
FIG. 4 is a diagram showing a relationship between a temperature and a compression ratio of display data according to the embodiments (first to third embodiments) of the present invention.

FIG. 4 shows a relationship between temperature and compression ratio. As shown in FIG. 4, in the first embodiment, for example, display is performed with a compression ratio α=0% in a temperature range of 0° C. or higher which is the normal temperature (a first temperature range) (A), display is performed with a compression ratio α=25% in a temperature range of −10° C. to less than 0° C. which is in a low temperature (a transition state between (A) and (C)) (a second temperature range) (B), and display is performed with a compression ratio α=50% in a temperature range of less than −10° C. which is in a further low temperature (a third temperature range) (C).

Incidentally, such definition of the relationship between the temperature and the compression ratio is not limited and the relationship may include various patterns, so that aspects corresponding to these patterns can be adopted.

<Grayscale-Output Voltage>

Figure 5:
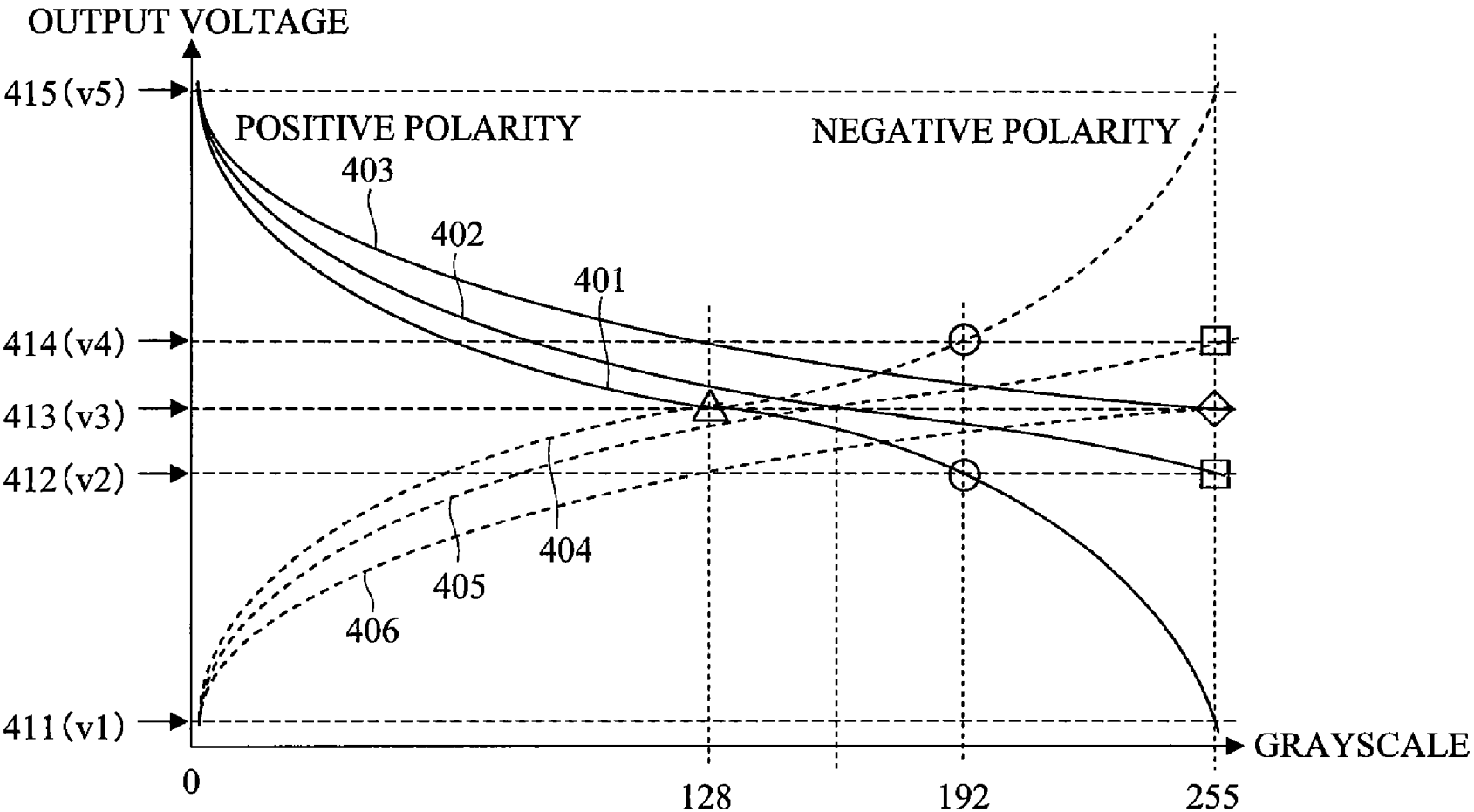
FIG. 5 is a diagram showing a relationship between grayscale of display data and output voltage (liquid crystal application voltage which is an output from a DA converter) according to the first embodiment of the present invention.

FIG. 5 shows a relationship between grayscale and output voltage (application voltage to a liquid crystal (306) to inputted grayscale data). A curve indicated by reference numeral 401 shows α=0% at the ordinary temperature time (A) at a positive polarity and a curve indicated by 404 shows the same at a negative polarity. In the liquid crystal (306), a potential of a common electrode is generally controlled, for each frame, to a voltage (v1) 411 at the positive polarity and a voltage (v5) 415 at the negative polarity, and application voltage to the liquid crystal is controlled to the curve 401 at the positive polarity and the curve 404 at the negative polarity so that continuous application of DC voltage to the liquid crystal is prevented and deterioration of the liquid crystal is prevented.

<Reference Voltage>

The reference voltage generating circuit 314 is a circuit which generates a plurality of reference voltages (331 to 336) corresponding to respective compression ratios (α), and it generates five kinds of voltages of v1 (411) to v5 (415) shown in FIG. 5 in the present embodiment. The voltages v5 is outputted to 333, v4 is outputted to 332, v3 is outputted to 331 and 334, v2 is outputted to 335, and v1 is outputted to 336, respectively.

The selector (S1) 321 selects one voltage from the voltages v1(336), v2(335), and v3(334) from the reference voltage generating circuit 314 according to the temperature information (T1) provided from the thermometer 307 to feed the selected one to the positive polarity ladder circuit (L1) 316. The selector (S2) 322 selects one voltage from the voltages v5(333), v4(332), and v3(331) according to the temperature information (T1) provided from the thermometer 307 to feed the selected one to the negative polarity ladder circuit (L2) 317.

The positive polarity ladder circuit (L1) 316 and the negative polarity ladder circuit (L2) 317 each have a configuration where a plurality of variable resistors and resistors are connected in series and they have a function of dividing a range of voltage applied from the reference voltage generating circuit 314 and the selectors (S1)321 and (S2)322 by the number of grayscales to generate liquid crystal application voltages corresponding to the respective grayscales.

<γ Setting Register>

The γ setting register 313 is a register storing set values of variable resistors in the positive polarity ladder circuit (L1) 316 and the negative polarity ladder circuit (L2)317, and it stores therein a plurality of set values corresponding to respective compression ratios (α) (total six registers are provided corresponding to positive and negative polarities and three compression ratios in this example). The set values are selected by the selectors (S3)323 and (S4)324 according to the temperature (T1) provided from the thermometer 307 to be supplied to the positive polarity ladder circuit (L1)316 and the negative polarity ladder circuit (L2)317. In the selectors (S3, S4), the voltage v1(411) is selected at the positive polarity and the voltage v5(415) is selected at the negative polarity at the normal temperature (0° C. or higher).

In order to conduct display with a compression ratio of α=25% at a low temperature (in a temperature range of −10° C. to less than 0° C.) (B), such design must be adopted that application voltage (circle marks in FIG. 5, v2, v4) of a grayscale value 192 (particularly, 256×0.75=192) at the normal temperature (A) is applied when the grayscale value 255 is given (square marks in FIG. 5). Accordingly, in the selectors (S3, S4), voltage of v2(412) is selected at the positive polarity and voltage of v4(414) is selected at the negative polarity at the low temperature (in a range of −10° C. to less than 0° C.) (B) so that they are fed to the ladder circuits (L1, L2).

In order to conduct display with a compression ratio of α=50% at a further low temperature (less than −10° C.) time (C), such design must be adopted that application voltage (a triangle mark in FIG. 5, v3) of a grayscale value 128 (particularly, 256×0.5=128) at the normal temperature (A) is applied when the grayscale value 255 is given (a diamond mark in FIG. 5). Accordingly, in the selectors (S3, S4), voltage v3(413) is selected at both the positive polarity and the negative polarity at the further low temperature time (C) to be fed to the ladder circuits (L1, L2).

Grayscale-output voltage characteristics of the curve 401 at the positive polarity and the curve 404 at the negative polarity are given to the γ setting register 313 at the normal temperature time (A). Besides the set values of the positive and negative ladder circuits (L1, L2), set values of the respective ladder circuits (L1, L2) giving the characteristic of the curve 402 at the positive polarity and the characteristic of the curve 405 at the negative polarity at the low temperature time (B) and set values of the respective ladder circuits (L1, L2) giving the characteristic of the curve 403 at the positive polarity and the characteristic of the curve 406 at the negative polarity at the further low temperature time (C) are similarly stored in the γ setting register 313.

<Operation>

An operation of the display device according to the first embodiment (switching control of the compression ratio (α), the output voltage (the reference voltage, the γ set value), and the backlight luminance conducted according to the temperature information T1) will be explained below. The CPU 302 writes a display start mode in a display start register (not shown) within the input/output IF 308 to transfer display data from the display memory 303 to the memory 310 via the input/output IF 308 when an image should be displayed on a screen of the liquid crystal panel 306.

The size (capacity) of the memory 310 may vary depending on a system to be applied but a system having a frame memory corresponding to one frame is commonly used recently. The size of the memory 310 is not limited to a specific one and a memory such as an FIFO memory with several bytes may be implemented.

For example, a vehicle compartment is put in a very low temperature state at a starting time of a vehicle in winter in cold climate area or the like. For example, when the device enters the display start mode at a temperature of −10° C. or lower (within the third temperature range (C)) at the starting time of the vehicle, the thermometer 307 outputs the temperature information (T1) to the backlight controller 312 and the respective selectors (S1)321 to (S4)324. Based upon the temperature information (T1), the respective selectors (S1)321 and (S2)322 regarding the reference voltage select the voltage v3(413) and the respective selectors (S3)323 and (S4)324 regarding the γ set value select the set value of the γ set setting register 313 for the compression ratio α=50% time. As a result, grayscale voltages outputted from the positive polarity ladder circuit (L1)316 and the negative polarity ladder circuit (L2)317 appear like the curve 403 of the positive polarity and the curve 406 of the negative polarity shown in FIG. 5. The grayscale voltages are outputted into the DA converter 315.

When the DA converter 315 is inputted with display data (grayscale data) from the memory 310, it selects a grayscale voltage corresponding to the display data from grayscale voltages provided from the respective ladder circuits (L1, L2) to output the selected one to the liquid crystal panel 306 as output voltage (liquid crystal application voltage).

<Backlight Luminance>

Figure 6:
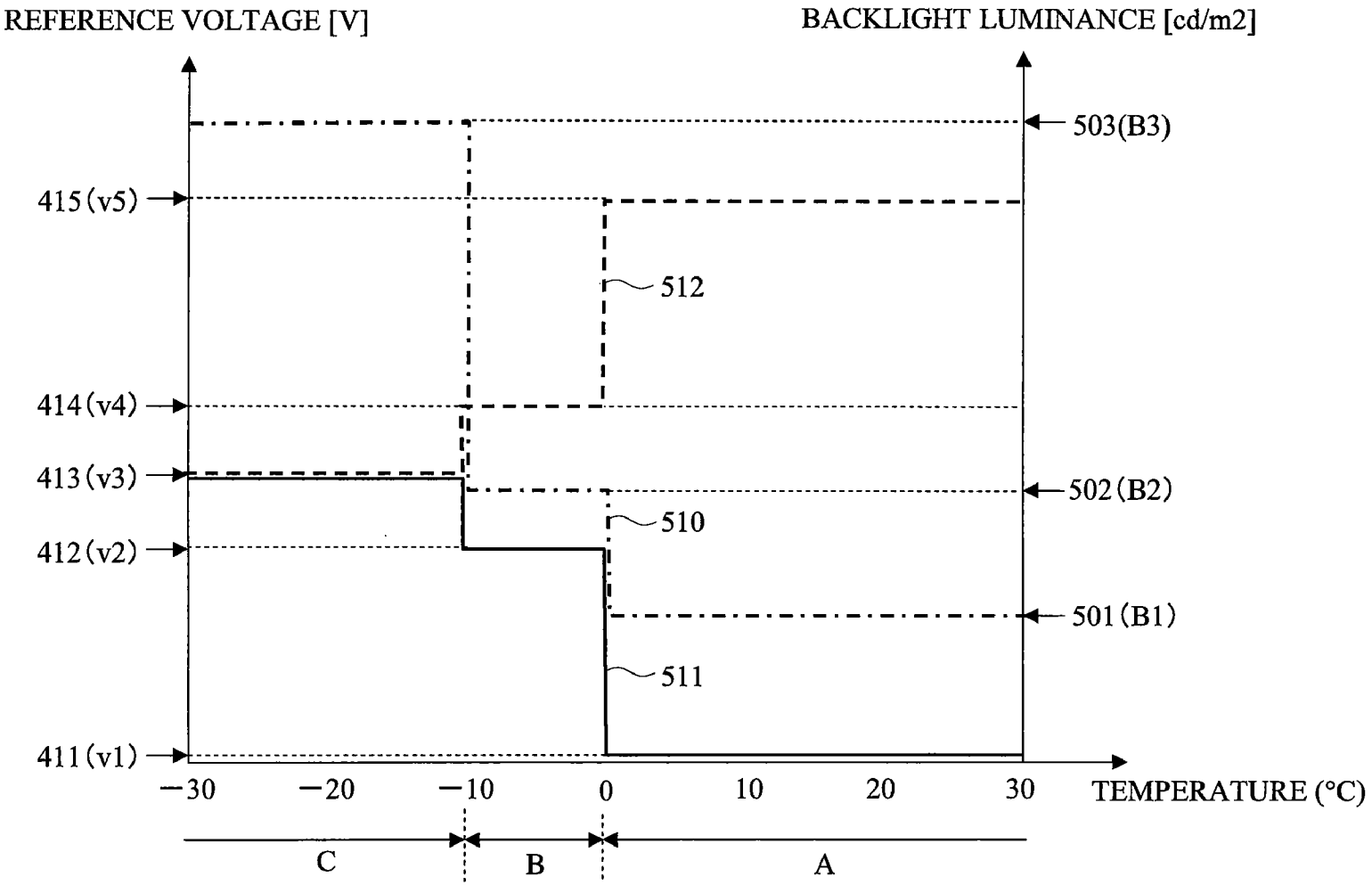
FIG. 6 is a diagram showing a relationship between a temperature, and a reference voltage applied to a grayscale voltage generating circuit (ladder circuit) and backlight luminance according to the first embodiment of the present invention.

Subsequently, FIG. 6 shows a relationship among a temperature (° C.), a reference voltage (V), and a backlight luminance (cd/m$^2$). Reference numeral 510 denotes a line defining the backlight luminance, 511 denotes a line defining the reference voltage (positive polarity time), and 512 denotes a line defining the reference voltage (negative polarity time). The backlight controller 312 conducts control by a backlight control signal (C1) such that the backlight 305 outputs a light amount (luminance) corresponding to a temperature state.

The backlight controller 312 conducts control such that backlight luminance (B3)503 which is about 4.6 times backlight luminance (B1)501 in the first temperature range (0° C. or higher) (A) is outputted in the third temperature range (−10° C. or lower) (C) as shown in a portion (B3) corresponding to (C) of the line 510 regarding the backlight luminance shown in FIG. 6. Thereby, as shown in FIG. 1, an image is displayed using only a range of grayscale 102 where the response of the liquid crystal (306) is fast (a low grayscale range) (x: a grayscale value of 128 or lower). As compared with a case where display is performed using the whole grayscale X, the response can be made very fast. In this case, since an analog processing is performed, excellent display can be obtained without causing grayscale jumping or lowering of luminance.

Next, it is assumed that the liquid crystal (306) is slightly warmed due to lighting of the backlight 305, use of an interior air conditioner, or the like so that the temperature has reached the second temperature range (−10° C. to lower than 0° C.) (B). Thereby, regarding the reference voltages, the selector (S2)322 selects the voltage v4(414) and the selector (S1)321 selects the voltage v2(412), and regarding the γ set value, the selectors (S3) 323 and (S4) 324 select the set value of the γ setting register 313 for the compression ratio α=25% time. As a result, the grayscale voltages outputted from the respective ladder circuits (L1, L2) to the DA converter 315 appear like the curves 402 and 405 shown in FIG. 5. Similar to the above, the DA converter 315 selects a grayscale voltage corresponding to the display data from the grayscale voltages from the ladder circuits (L1, L2) to output the same to the liquid crystal panel 306.

The backlight controller 312 conducts control such that backlight luminance (B2)502 which is about 1.9 times the backlight luminance (B1)501 in the first temperature range (A) is outputted in the second temperature range (B) as shown in a portion (B2) corresponding to (B) of the line 510 in FIG. 6. Thereby, an image is displayed using only a range of grayscale (transmissivity) (x: a grayscale value of 192 or lower) where the response of the liquid crystal (306) is slightly fast. As compared with the case that display is performed using the whole grayscale (X), the response can be made fast without changing the display image quality.

Next, it is assumed that the liquid crystal (306) is further warmed to reach the first temperature range (0° C. or higher) (A). Thereby, the selector (S2)322 selects the voltage v5(415), the selector (S1)321 selects the voltage v1(411), and the selectors (S3)323 and (S4)324 select the set values of the γ setting registers 313 for the compression ratio α=0% time. As a result, the grayscale voltages outputted from the respective ladder circuits (L1, L2) to the DA converter 315 appear like the curves 401 and 404 shown in FIG. 5. Similar to the above, the DA converter 315 selects a grayscale voltage corresponding to the display data from the grayscale voltages from the ladder circuits (L1, L2) to output the same to the liquid crystal panel 306.

The backlight controller 312 conducts control such that the backlight 305 outputs the backlight luminance (B1)501 in the first temperature range (0° C. or higher) (A) as shown in a portion (B1) corresponding to (A) of the line 501 shown in FIG. 6. Thereby, consumption of power due to excessively increasing the luminance of the backlight 305 is suppressed so that ordinary liquid crystal display can be obtained with ordinary power.

By conducting control in the above manner, the response of the liquid crystal (306), especially, at the low temperature time ((B), (C)) can be made fast without degrading display quality in the present device.

With the above configuration, a plurality of γ setting registers 313 are provided and set values or reference voltages are automatically selected in the respective selectors (S1 to s4) according to the information (T1) provided from the thermometer 307. The present invention is not limited to this configuration, where such a configuration can be adopted that the thermometer 307 is monitored by the CPU 302 and after the set values of the γ setting registers 313 are rewritten by the CPU 302, the output value of the reference voltage generating circuit 314 is switched by the CPU 302. In this case, increase of a circuit scale due to increase of the number of registers (313) can be suppressed.

Second Embodiment

Next, a liquid crystal display and a liquid crystal driver according to a second embodiment of the present invention will be explained with reference to FIGS. 7 and 8. In the second embodiment, a basic operation thereof is similar to that of the first embodiment, but a feature of the second embodiment lies in a configuration where both an overdrive function and a characteristic system in the present invention are used, and the second embodiment is different in a circuit system regarding a display data compression processing from the first embodiment. In the second embodiment, regarding a grayscale compression processing, grayscale voltages of the number more than the number of grayscales are produced in a configuration where the grayscale voltage generating circuit (ladder circuit) is sub-divided and an output grayscale voltage is selected from the grayscale voltages produced.

Figure 7:
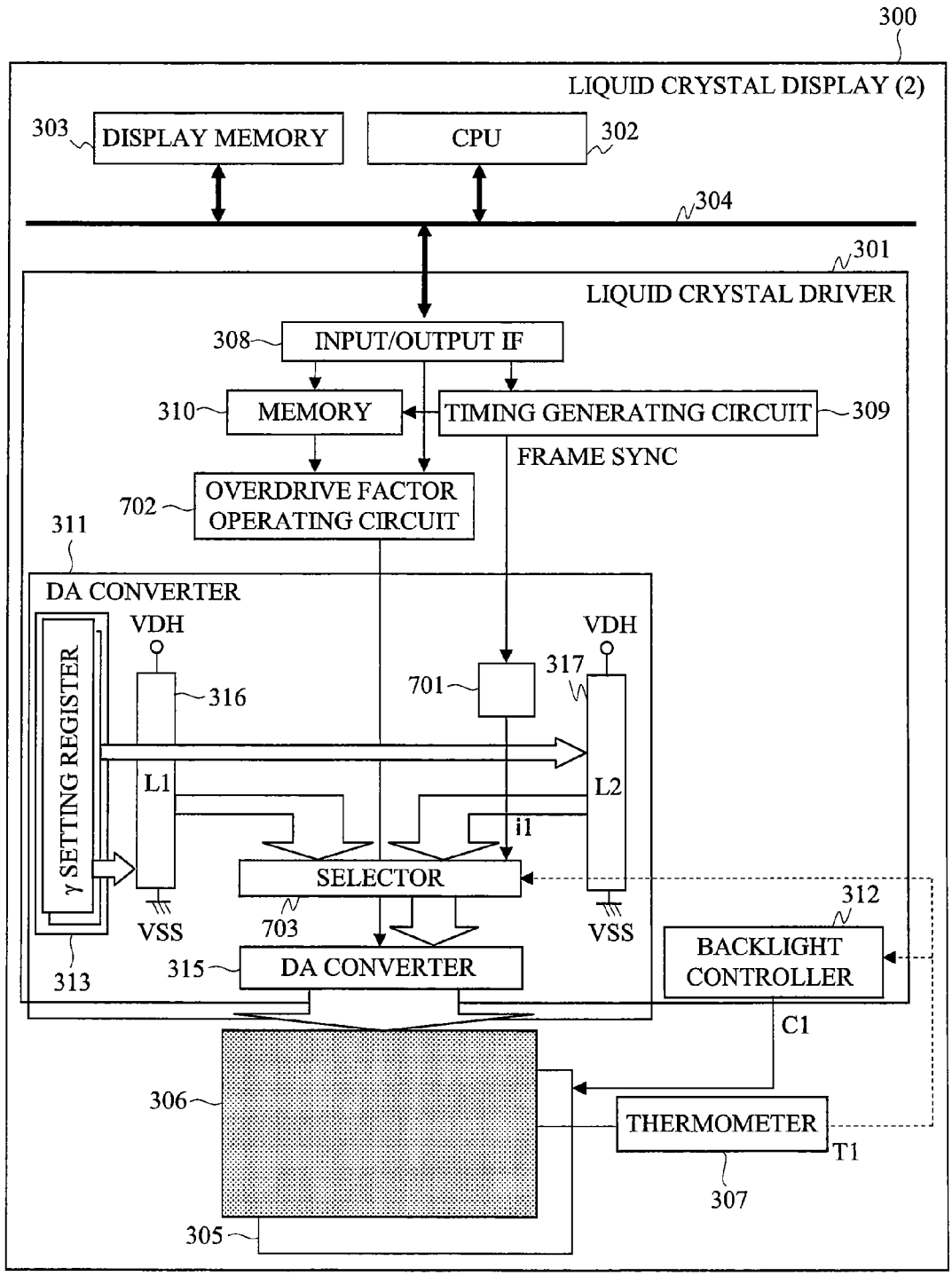
FIG. 7 is a diagram showing a block configuration in a display device according to the second embodiment of the present invention.

FIG. 7 shows a block configuration of a liquid crystal display 300 according to the second embodiment. A liquid crystal driver 301 includes an overdrive factor operating circuit 702 positioned at a downstream stage of a memory 310 and an input/output IF 308, and also includes a DA converting section 311 different from that in the first embodiment at a downstream stage of the overdrive factor operating circuit 702.

<Overdrive Function>

The overdrive factor operating circuit 702 is a circuit having a function of outputting application voltage (overdrive application voltage) to a liquid crystal (306) for conducting overdrive in a form of a grayscale value K (overdrive factor). The overdrive factor operating circuit 702 compares a pixel value (grayscale value $k_{i-1}$) of the previous frame from the memory 310 and a pixel value (grayscale value $k_i$) of the current frame from the input/output IF 308 with each other (namely, calculates a grayscale difference value between frame pixels) and when these pixel values are equal to each other, the overdrive factor operating circuit 702 outputs the grayscale values of the pixel values as they are.

When the pixel value ($k_i$) of the current frame is higher in grayscale than the pixel value ($k_{i-1}$) of the previous frame (the grayscale difference value ($k_i-k_{i-1}$) is positive), the overdrive factor operating circuit 702 outputs a value K($K=k_i+a$) obtained by adding a value "a" to the grayscale value ($k_i$) of the current pixel value. Here, "a" is a positive integer, and the maximum value where overshoot of luminance falls within a fixed value when a voltage value corresponding to the grayscale value $K=k_i+a$ is applied to the liquid crystal (306) by one frame is prepared in a form of LUM (Look UP Table) in advance. When the current pixel value ($K_i$) is lower in grayscale than the pixel value ($k_{i-1}$) of the previous frame (the grayscale difference value ($k_i-k_{i-1}$) is negative), the overdrive factor operating circuit 702 outputs a value K($K=k_i-b$) obtained by subtracting a value "b" from the grayscale value ($k_i$) of the current pixel value. Here, "b" is a positive integer, and the maximum value where undershoot of luminance falls within a fixed value when a voltage value corresponding to the grayscale value $K=k_i-b$ is applied to the liquid crystal (306) by one frame is prepared in a form of LUT in advance. The above is similar to the known overdrive technique.

The DA converting section 311 is configured to include γ setting registers (two for positive polarity and negative polarity) 313, a positive polarity ladder circuit (L1)316, a negative polarity ladder circuit (L2)317, a DA converter 315, a selector 703, and a counter (positive polarity and negative polarity counter) 701.

The counter 701 is a counter whose state changes for each reception of frame SYNC (synchronization) signals which are outputs of a timing generating circuit 309 in such a manner as positive polarity, negative polarity, positive polarity, . . . .

<Ladder Circuit and Selector>

Figure 8:
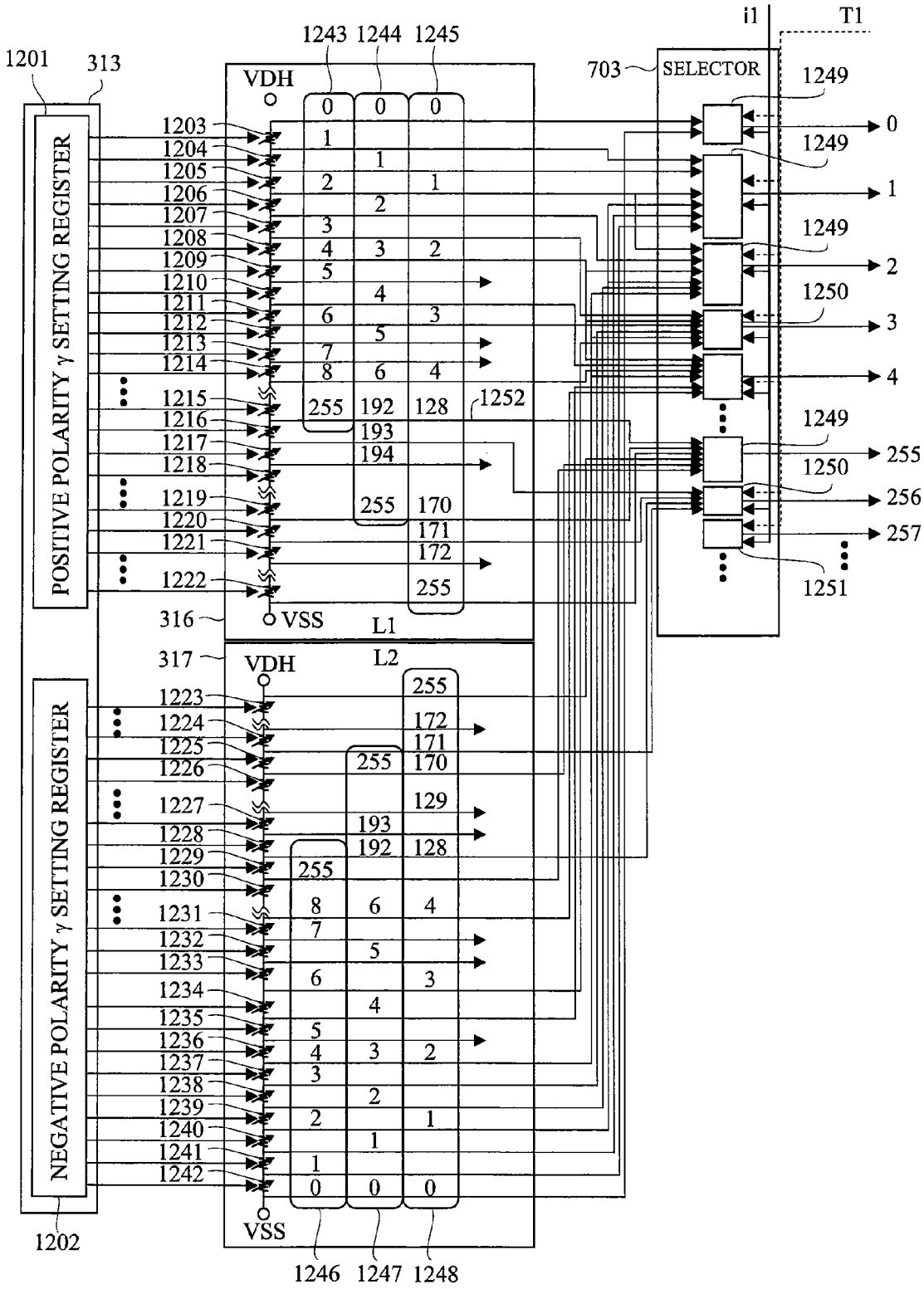
FIG. 8 is a diagram showing a specific circuit configuration of a DA converting section (each ladder circuit, selector) according to the second embodiment of the present invention.

FIG. 8 shows a specific circuit configuration of the positive polarity ladder circuit (L1)316, the negative polarity ladder circuit (L2)317, and the selector 703 in the DA converting section 311. As shown in FIG. 8, the positive polarity ladder circuit (L1)316 and the negative polarity ladder circuit (L2) 317 are configured by connecting variable resistors 1203 to 1222 and 1223 to 1242 in series, respectively. The set values of the variable resistors 1203 to 1222 and 1223 to 1242 are set in the positive polarity γ setting register 1201 and the negative polarity γ setting register 1202 of γ setting register. Here, it is not required that all resistors contained in the positive polarity ladder circuit (L1)316 and the negative polarity ladder circuit (L2)317 and connected in series are variable resistors, and they may include a resistor(s) having a fixed value. 255 or more grayscale voltage values are outputted from each of the ladder circuits (L1, L2). Also in the second embodiment, it is assumed that the relationship between the temperature and the compression ratio α is as shown in FIG. 4 mentioned above. It is also assumed that an output voltage value to each grayscale for each temperature from the DA converter 315 is as shown in FIG. 5 mentioned above. That is, the relationship between the grayscale and the output voltage value is represented by the curve 401 at the positive polarity and it is represented by the curve 404 at the negative polarity at the compression ratio $\alpha$=0% in the first temperature range (A), it is represented by the curve 402 at the positive polarity and it is represented by the curve 405 at the negative polarity at the compression ratio $\alpha$=25% in the second temperature range (B), and it is represented by the curve 403 at the positive polarity and it is represented by the curve 406 at the negative polarity at the compression ratio $\alpha$=50% in the third temperature range (C).

In FIG. 8, reference numerals 1243 to 1248 denote frames provided for explaining the relationship between the grayscale value and the grayscale voltage output, where 1243 and 1246 describe the relationship between the grayscale value and the grayscale voltage output at the third temperature range (C), 1244 and 1247 describe the relationship between the grayscale value and the grayscale voltage output at the second temperature range (B), and 1245 and 1248 describe the relationship between the grayscale value and the grayscale voltage output at the first temperature range (A). As understood from FIG. 5 mentioned above, the output voltage v3(413) corresponds to the grayscale value 128 in the first temperature range (A), it corresponds to the grayscale value 192 in the second temperature range (B), and it corresponds to the grayscale value 255 in the third temperature range (C). Accordingly, the grayscale voltage output 1252 outputting the output voltage v3(413) corresponds to the grayscale value 255 in the frame 1243, it corresponds to the grayscale value 192 in the frame 1244, and it corresponds to the grayscale value 128 in the frame 1245. The plurality of selectors 1249 to 1251 in the selector 703 receive positive polarity and negative polarity information (i1) from the counter 701 and temperature information (T1) from the thermometer 307 to select one grayscale voltage from a plurality of grayscale voltages based upon these information and output the same to the DA converter 315.

Further, in the configuration, the frames 1243, 1244, 1246, 1247, and the like each have a margin in the output voltages of the ladder circuits (L1, L2) to the grayscale value 255 at the low temperature time ((B), (C)). The output voltage portion is outputted as the overdrive application voltage from the selector 703 such as the selector 1250 regarding the grayscale value 256, the selector 1251 regarding the grayscale value 257, . . . . With such a configuration, when the overdrive factor ($K=k_i+a$) exceeds the grayscale value 255 in the low temperature time ((B), (C)) where the response is slow, the liquid crystal (306) can be driven (overdriven) with an optimal overdrive factor so that further high speed can be achieved.

Third Embodiment

Next, a liquid crystal display and a liquid crystal driver according to a third embodiment of the present invention will be explained with reference to FIG. 9. A feature of the third embodiment lies in a system of a digital processing where a display data compression processing is performed as the grayscale value remains. In the third embodiment, an overdrive factor (grayscale value K) is calculated by an overdrive factor operating circuit 702. The liquid crystal driver 301 is provided with a data compression factor output circuit 801 and compression operating circuits 802 and 803, and the data compression factor output circuit 801 outputs a fixed value as data compression factor $\beta(\beta=1-\alpha)$ based upon the temperature information (T1) provided from the thermometer 307. The data compression factor $\beta$ is outputted to the compression operating circuits 802, 803 and a backlight controller 312.

For example, when control is performed at the compression ratio $\alpha$ shown in FIG. 4, as the data compression factor $\beta$, the data compression factor $\beta$=1 is outputted at the normal temperature time (0° C. or higher) (A), the data compression factor $\beta$=0.75 is outputted at the low temperature time (−10° C. to lower than 0° C.) (B), and the data compression factor $\beta$=0.5 is outputted at the further low temperature time (lower than −10° C.) (C). In the compression operating circuits 802, 803, display data (input pixel data) of the previous frame provided from the memory 310 and display data of the current frame provided from the input/output IF 308 are multiplied by the data compression factor $\beta$ provided from the data compression factor output circuit 801 so that output to the overdrive factor operating circuit 702 is performed. In the overdrive factor operating circuit 702, change to a writing grayscale considering overdrive is performed based upon the temperature information (T1), and output to the liquid controller 804 is performed. Writing in the liquid crystal (306) is performed by the liquid crystal controller 804 (the known configuration).

In the third embodiment, the number of colors is reduced corresponding to the display data compression processing performed, but since the overdrive factor operating circuit 702 is provided at a downstream stage of the compression operating circuits 802, 803, the overdrive factor operation can be performed with a fixed operation regardless of the compression ratio $\alpha$ (the circuit configuration can be fixed). Also in the third embodiment, a writing grayscale to the liquid crystal (306) is 192 in the low temperature time of −10° C. to lower than 0° C. (B) when the grayscale of display data is 255, and the writing grayscale is 128 in the low temperature time of lower than −10° C. (C) when the grayscale of display data is 255, where a portion of the writing grayscale up to 255 can be used for overdrive like the second embodiment. Therefore, application of sufficient overdrive application voltage can be performed even at a transition time of the display grayscale to 255 (the highest grayscale), so that further speed-up can be achieved in addition to the speed-up obtained by the display data compression processing.

Fourth Embodiment

Next, a liquid crystal display and a liquid crystal driver according to a fourth embodiment of the present invention will be explained with reference to FIGS. 10 to 12. A feature of the fourth embodiment lies in that the liquid crystal panel 306 comprises a VA liquid crystal. In general, the VA liquid crystal has such a property that response from a low grayscale to an intermediate grayscale is slow. Accordingly, contrary to the case of the TN liquid crystal (the first to third embodiments), a display data compression processing for compressing (changing) display data (grayscale range) to a high grayscale side is performed in the fourth embodiment (similar to FIG. 1 described above in concept). Thereby, the response can be made fast.

Figure 10:
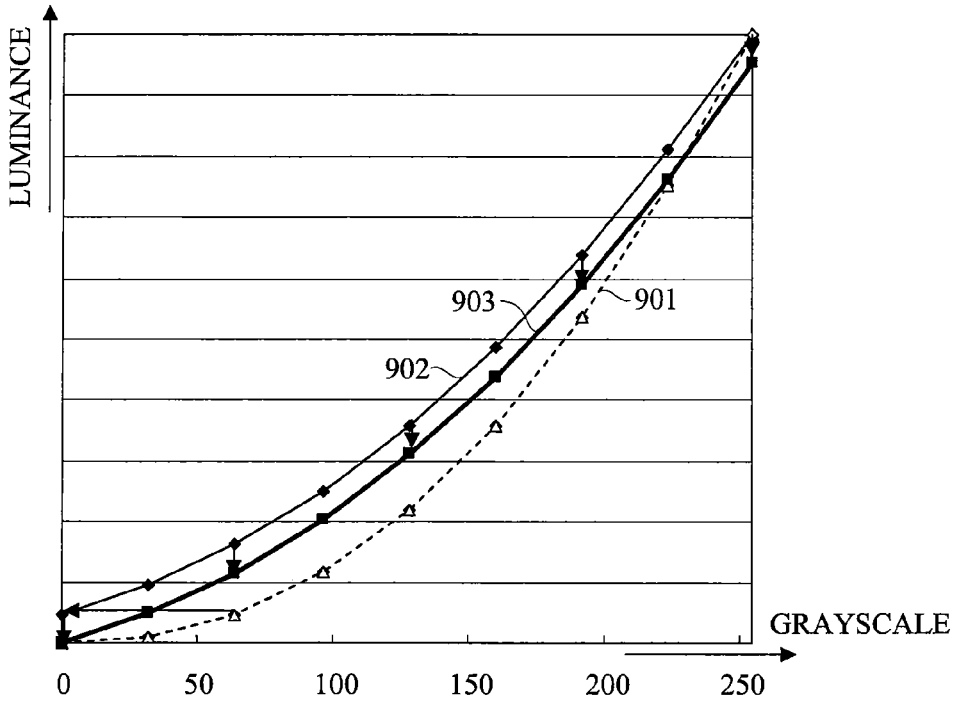
FIG. 10 is a diagram a showing a relationship between grayscale and luminance in a display device according to a fourth embodiment of the present invention.

FIG. 10 shows a grayscale-luminance characteristic regarding the fourth embodiment. Reference numeral 901 denotes characteristic at the normal temperature time (0° C. or higher) (A). Reference numeral 902 denotes characteristic at a compression time to a high grayscale side at the low temperature time. Reference numeral 903 denotes characteristic obtained by backlight luminance adjustment at the low temperature time.

FIG. 11 shows a relationship between the temperature, and the compression ratio $\alpha$ and the luminance characteristic in the fourth embodiment. In the fourth embodiment, as shown by line 1110, the compression ratio $\alpha$=0% is defined at the normal temperature time (0° C. or higher) (A), and the compression ratio $\alpha$=25% is defined at the low temperature time (lower than 0° C.) (D). As shown by line 1120, the backlight luminance at the normal temperature time (A) is defined like B5(1101). Display data is compressed to a high grayscale side at the low temperature time (D) so that characteristic shown by reference numeral 902 in FIG. 10 is obtained. Thereby, backlight luminance is lowered by a reduction amount of black level like B4(1102) shown in FIG. 11 so that characteristic shown by reference numeral 903 in FIG. 10 is obtained.

Figure 9:
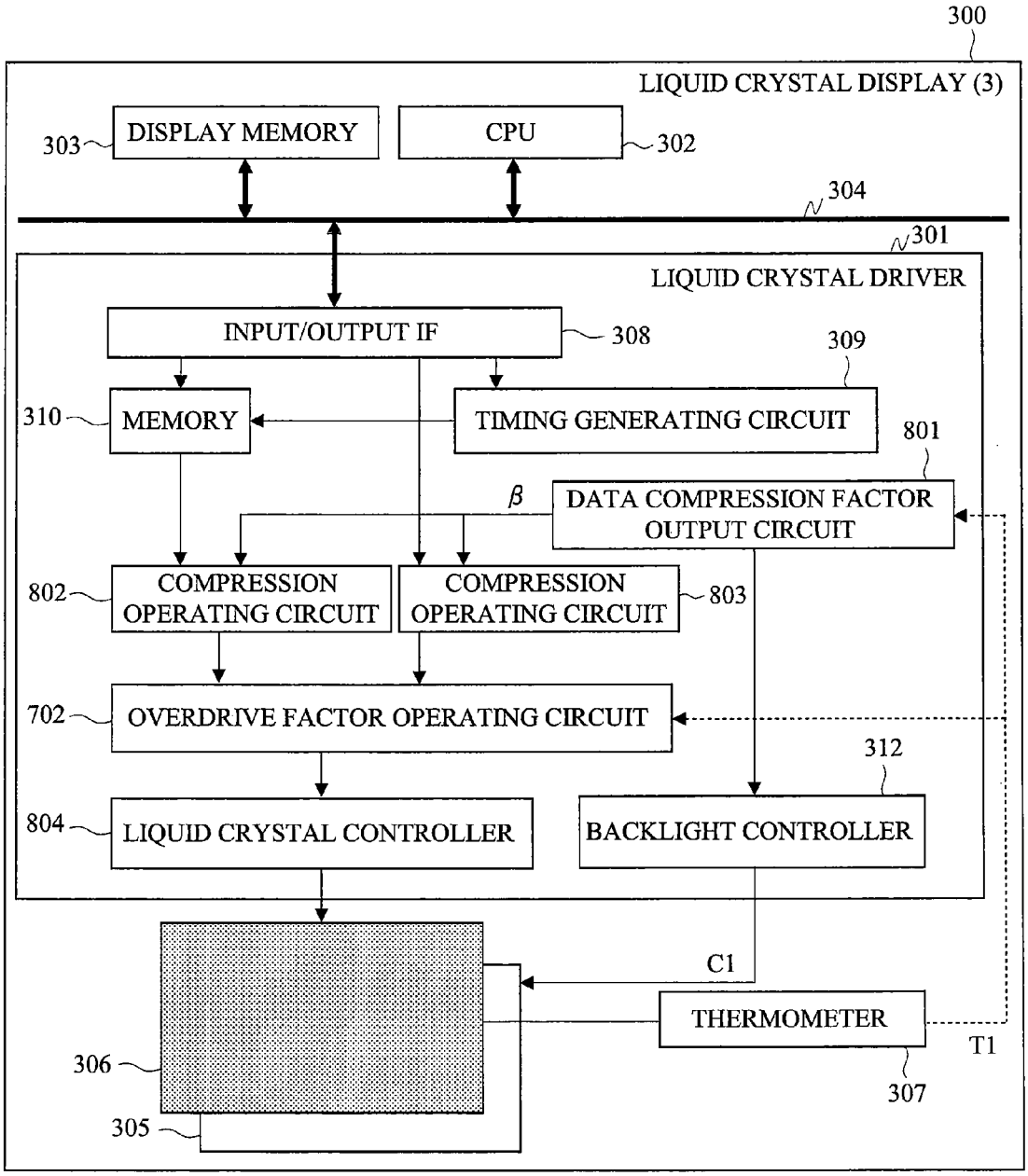
FIG. 9 is a diagram showing a block configuration in a display device according to the third embodiment of the present invention.

A block configuration of the fourth embodiment is similar to the configuration of the third embodiment shown in FIG. 9 described above, for example. A configuration similar to those in the first to third embodiments can be applied to the case of the VA liquid crystal. In the compression operating circuits 802, 803, when the compression ratio is represented as $\alpha$, an input grayscale is represented as x (which is different from x in FIG. 1), and an output grayscale is represented as y, an operation shown by the following mathematical expression (4) is performed.

$$y=(1-\alpha)x+255\alpha\Lambda \quad (4)$$

By conducting the operation in this manner, characteristic shown by reference numeral 902 in FIG. 10 can be realized. By conducting control in this manner, since a transition from a low grayscale, where response is slow, to an intermediate grayscale can be excluded, response can be made fast even in the VA liquid crystal.

FIG. 12 shows characteristic of grayscale-output voltage corresponding to the fourth embodiment. In the fourth embodiment, the display data compression processing is performed by the digital operation, but the DA converting section 311 is devised and the characteristic of grayscale-output voltage is realized such that a curve 1001 appears at the positive polarity and a curve 1003 appears at the negative polarity at the normal temperature time (A), and a curve 1002 appears at the positive polarity and a curve 1004 appears at the negative polarity at the low temperature time (D), as shown in FIG. 12, so that realization can be made even in the VA liquid crystal like the TN liquid crystal (first and second embodiments).

As explained above, according to each embodiment, the response at the low temperature time of the liquid crystal (306) can be made fast so that moving picture characteristic can be improved. A liquid crystal display which can be used in a wide temperature range can be provided. For example, in the TN liquid crystal, response can be made fast by compressing display data to a low grayscale side to perform display and increasing a light amount of the backlight 305. On the contrary, in the VA liquid crystal, response can be made fast by compressing display data to a high grayscale side to perform display and decreasing a light amount of the backlight 305 to suppress black separation.

The present invention can be applied to various devices such as, for example, a liquid crystal display for vehicle mounting, a television set using a liquid crystal display, a PC, or a mobile phone.

While we have shown and described several embodiments in accordance our invention, it should be understood that disclosed embodiments are susceptible of changes and modifications without departing from the scope of the invention. Therefore, we do not intend to be bound by the details shown and described herein but intend to cover all such changes and modifications within the ambit of the appended claims.

What is claimed is:

1. A driving circuit provided in a display device for displaying an image, the display device including a light source, a light amount of which is controllable, and a display panel including an element, the optical transmissivity of which is controllable, wherein the driving circuit includes a first processing portion which controls the optical transmissivity of the element in accordance with a grayscale of the image to be displayed on the display panel, wherein a response speed of the element is slower in a first grayscale range and is faster in a second grayscale range of a whole grayscale range available for displaying the image, the response speed being fast when a temperature in a vicinity of the element is high and being slow when the temperature in the vicinity of the element is low, the driving circuit performing a control processing operation of changing a range of the grayscale to be used for displaying the image based on the temperature in the vicinity of the element, the control processing operation changing the range of the grayscale to be used for displaying the image so that the whole grayscale range including the first grayscale range is used when the temperature in the vicinity of the element is higher than or equal to a reference temperature, and a partial grayscale range including the second grayscale range is used when the temperature in the vicinity of the element is below the reference temperature, and to change the grayscale range from the whole grayscale range to the partial grayscale range, the driving circuit performs a first processing operation of compressing a grayscale value of a display data of the image and changing the optical transmissivity of the element by making the optical transmissivity correspond to the compressed grayscale value of the display data.

2. The driving circuit according to claim 1, wherein the driving circuit includes a second processing portion which controls the light amount of the light source in accordance with the grayscale of the image to be displayed, and to change the range from the whole grayscale range to the partial grayscale range, the driving circuit performs a second processing operation of changing the light amount of the light source based on the compressed grayscale value of the display data of the image.

3. The driving circuit according to claim 2, wherein upon changing the grayscale range from the whole grayscale range to the partial grayscale range in the control processing operation, the driving circuit increases the light amount of the light source in the second processing operation, the increase in the light amount being correlated with an amount by which luminescence is lowered when lowering the optical transmissivity of the element in the first processing operation, such that luminance of the image to be displayed on the panel is compensated to coincide or be close to an original luminance corresponding to a grayscale value before the compression.

4. The driving circuit according to claim 2, wherein the display panel is a liquid crystal display panel, the element is a VA liquid crystal element having characteristics such that the grayscale of the image is maximum when a voltage is not applied to the element, and a transition from a low grayscale to a high grayscale is slow, the first grayscale range is a range on a low grayscale side below a first value and the second grayscale range is a range on a high grayscale side higher than or equal to the first value, to change the grayscale range from the whole grayscale range to the partial grayscale range, the driving circuit decreases the optical transmissivity of the element in accordance with the grayscale value of the compressed display data which is in the partial grayscale range including the second grayscale range, and the driving circuit increases the light amount of the light source to correlate with a compressed amount of the grayscale value.

5. The driving circuit according to claim 2, wherein the display panel is a liquid crystal display panel, the element is a TN liquid crystal element having characteristics such that the grayscale of the image is maximum when a voltage is not applied to the element, and a transition from a low grayscale to a high grayscale is slow, the first grayscale range is a range on a high grayscale side higher than or equal to a first value and the second grayscale range is a range on a lower grayscale side below the first value, to change the grayscale range from the whole grayscale range to the partial grayscale range, the driving circuit decreases the optical transmissivity of the element in accordance with the grayscale value of the compressed display data which is in the partial grayscale range including the second grayscale range, and the driving circuit increases the light amount of the light source to correlate with a compressed amount of the grayscale value.

6. The driving circuit according to claim 5, further comprising:

a grayscale voltage generating circuit which generates a grayscale voltage corresponding to a grayscale and outputs the grayscale voltage to a liquid crystal element of the display panel;

a selector circuit which receives information about the temperature in the vicinity of the element of the display panel and performs a control operation of changing a reference voltage value to be applied to the grayscale voltage generating circuit based on the temperature; and a light source control circuit which receives information about the temperature in the vicinity of the element of the display panel and performs control for changing the light amount of the light source based on the temperature.

7. The driving circuit according to claim 5, further comprising:

a grayscale voltage generating circuit which generates a grayscale voltage corresponding to a grayscale and outputs the grayscale voltage to a liquid crystal element of the display panel;

a register circuit which stores a plurality of y adjustment set values to be inputted into the grayscale voltage generating circuit;

a selector circuit which receives information about the temperature in the vicinity of the element of the display panel and performs control of changing a reference voltage value to be applied to the grayscale voltage generating circuit in accordance with the temperature; and a light source control circuit which receives information about the temperature in the vicinity of the element of the display panel and performs control for changing the light amount of the light source based on the temperature.

8. The driving circuit according to claim 5, further comprising:

a grayscale voltage generating circuit which generates grayscale voltages corresponding to a number of grayscales larger than a number of grayscales of the image to be displayed and outputs the grayscale voltages to the liquid crystal element;

a selector circuit which receives information about the temperature in the vicinity of the element and selects the grayscale voltage generated in the grayscale voltage generating circuit based on the temperature; and a light source control circuit which receives information about the temperature in the vicinity of the element of the display panel and performs control for changing the light amount of the light source based on the temperature.

9. The driving circuit according to claim 5, further comprising a circuit which performs an operation for compressing the range of grayscale of the display data to the low grayscale side by multiplying a grayscale value in the display data of the image by a fixed value (β) equal to or less than 1 upon changing the range from the whole grayscale range to the partial grayscale range.

10. The driving circuit according to claim 8, further comprising a circuit which multiplies a grayscale voltage to be applied to the liquid crystal element by a factor that corresponds to a grayscale difference value between images, to perform overdrive, wherein, in the control processing, a grayscale voltage for a grayscale in the whole grayscale range, which is not used as a result of the compression in the first processing, is used to perform the overdrive.

* * * * *